United States Patent [19]

Martincic et al.

[11] 4,270,110

[45] May 26, 1981

[54] BUS BAR ADAPTOR FOR WINDOW TYPE CURRENT TRANSFORMERS

[75] Inventors: Paul W. Martincic, Sharpsville; Charles E. Greene, Sharon, both of Pa.

[73] Assignee: Westinghouse Electric Corp., Pittsburgh, Pa.

[21] Appl. No.: 127,618

[22] Filed: Mar. 6, 1980

[51] Int. Cl.[3] ..... H01F 40/06

[52] U.S. Cl. ..... 336/174; 174/175

[58] Field of Search ..... 336/173, 174, 175, 198, 336/208; 174/175, 171; 248/74 A

[56] References Cited

U.S. PATENT DOCUMENTS 3,582,852 6/1971 Stetson ..... 336/174

*Primary Examiner*—Thomas J. Kozma

*Attorney, Agent, or Firm*—D. R. Lackey

[57] ABSTRACT

A one-piece insulated bus bar adaptor is removably attachable by spaced attachment sides having recesses for receiving retainer projections extending from the opposite end walls of a window type current transformer so that the adaptor is attached in a predetermined indexed position within the transformer opening with a bar mounting slot thereof having a predetermined fixed position for securing the current transformer.

4 Claims, 6 Drawing Figures

BUS BAR ADAPTOR FOR WINDOW TYPE CURRENT TRANSFORMERS

BACKGROUND OF THE INVENTION

This invention relates to a through or window type of current transformer and more particularly to an improved detachable adaptor arrangement for mounting and securing such transformers on a bar primary conductor in a predetermined indexed position.

As is known, the through or window type of current transformers include only a secondary winding wound on a magnetic core through which a bus, transformer terminal or other primary conductor may be passed to serve as the primary winding. The output of the secondary winding of the current tranformer is used for measuring primary current at predetermined and proportionally reduced values provided by the current transformer ratio values. Since the primary conductors received by the current transformers may have different shapes, the current transformers must be adapted for different mountings when receiving the different shaped conductors. However, one extensive use of the current transformers is on rectangular bus bars or spade terminals extending from insulating bushings of high voltage distribution transformers.

Auxiliary bus bar adaptors are known and in one example the adaptor is cemented or bonded within the window opening of a current transformer for adapting it for mounting on spade terminals or other rectangular bar conductors. An adaptor of the aforementioned type is disclosed in U.S. Pat. No. 3,582,852 wherein the described adaptor is not intended to be both removable and reattachable to the transformer. A detachable type of auxiliary adaptor is disclosed in U.S. Pat. No. 3,742,410, assigned to the assignee of this invention. The detachable adaptor includes metal clips for resiliently engaging the opposite outer sides of the transformer. The clips are each separately formed and then the body of the adaptor is molded around the clips so as to form a bar receiving groove for mounting the transformer. While the aforementioned types of adaptors are suitable in many transformer mounting applications, they do not afford a separately attachable adaptor arrangement that is economically manufactured entirely of an insulating material and is attachable to the transformers in a predetermined indexed orientation.

SUMMARY OF THE INVENTION

In accordance with the present invention, a detachable bus bar adaptor for window type current transformers readily provides various modes of mounting and includes a one-piece molded construction which is easily and economically manufactured. The adaptor has a generally U-shaped side configuration including a base extending between the transformer end walls and having an arcuately convex cross-sectional surface complementary to the curved and typically oval inner wall of the tranformer casing defining the center opening thereof. A pair of oppositely-disposed flat sides extend outwardly from the ends of the base part to form the U-shaped configuration and provide attachment members for overlapping the end walls of the current transformer. The attachment members include pairs of circular recesses disposed in mutually opposing relationship. The current transformer is provided with pairs of cylindrical projections having predetermined positions for fitting into the recesses of the attachment members and retaining the adaptor in a predetermined indexed position. A bar mounting portion of the adaptor extends inwardly from the base for forming a slot extending parallel to the base. Sawtooth projections extend in opposing pairs from the side walls defining this slot for resiliently gripping a rectangular bar primary conductor. The current transformer includes symmetrically and oppositely disposed upper and lower sets of the end projections. Thus, an arrangement for retaining a pair of identical ones of the bus bar adaptors in predetermined mutually indexed relationships is provided when positioned within the opening of the current transformer. The pair of bus bar adaptors are simply and easily attachable to the current transformer end walls for mounting and securing the transformer to the opposite sides of a bar conductor conducting a primary current flow to be measured. Other advantages and features of the present invention will be apparent from the detailed description thereof taken in connection with the drawings briefly described hereinafter.

DETAILED DESCRIPTION OF THE PREFERRED EMBODIMENT

Figure 1:
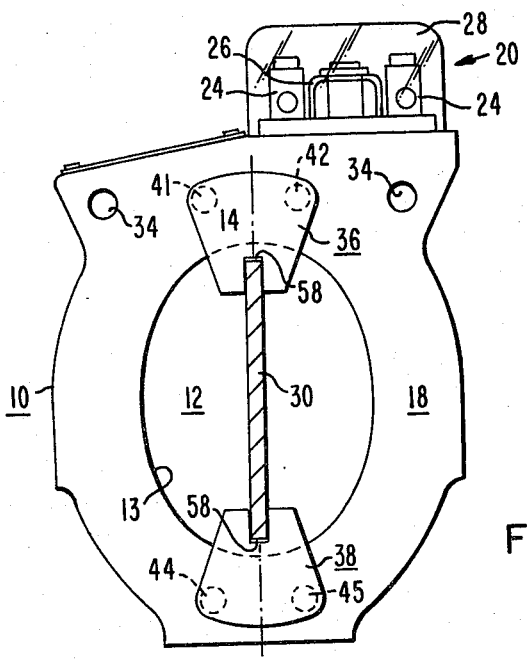
FIG. 1 is an end elevational view of a window type current transformer including a bus bar adaptor arrangement made in accordance with this invention for securing the transformer to a rectangular bar conductor shown in cross section.

Referring now to the drawings and more particularly to FIG. 1, there is shown an end elevational view of a through or window type current transformer 10 having an oval opening 12 formed by an inner wall 13 extending symmetrically about a center vertical axis 14. The transformer casing is made of a molded insulating material and particularly includes substantially flat parallel end walls 16 and 18, shown in FIG. 2, terminating inwardly at the substantially straight axial surface defining the inner wall 13 around the oval opening 12. The electrical and magnetic parts of the transformer 10 include a magnetic core having a secondary winding thereon enclosed by the transformer casing. The wire ends of the transformer winding are connected to the transformer terminal assembly 20 provided at the top 22 of the transformer 10. A pair of external bolt or screw-type terminals 24, a shunting bar 26 and a transparent cover 28 are provided in the terminal assembly 20 as described and claimed in U.S. Patent Application Ser. No. 873,032, filed Jan. 27, 1978 and assigned to the assignee of this invention. The pair of external terminals 24 are typically connected to an electric power or current measuring instrument or to an electric energy watt-hour meter measuring the primary current of a conductor passing through the opening 12 of the current transformer 10.

The current transformer 10 includes only a secondary type of winding and the opening 12 receives various shaped conductors defining an external single turn primary winding carrying a primary current to be detected by the current transformer 10. When the transformer 10 receives circular bus bars or cables or conductors other than those having a rectangular cross section as indicated by the conductor 30, the current transformer 10 is mountable by a pair of top through holes 34 and an auxiliary plate, not shown, providing a lower pair of mounting holes.

First and second auxiliary bus bar adaptors 36 and 38 provide the unique securing arrangement of the present invention when a rectangular bar conductor 30 forms the transformer primary conductor. Such conductors are formed by rectangular bus bars or spade terminals of a distribution transformer conducting a primary current to be measured. The adaptors 36 and 38 are identical and are detachably retained by the current transformer 10 in a predetermined indexed orientation relative to each other and to the transformer opening 12 along the vertical axis 14 as described in detail hereinbelow. The separate like parts of each of the adaptors are designated by the same numerals.

Figure 2:
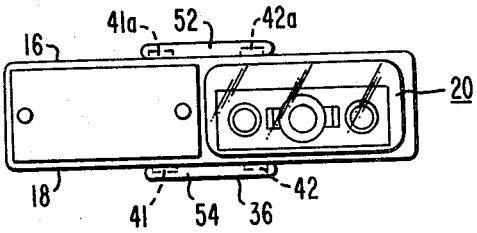
FIG. 2 is a top elevational view of the current transformer shown in FIG. 1.
Figure 3:
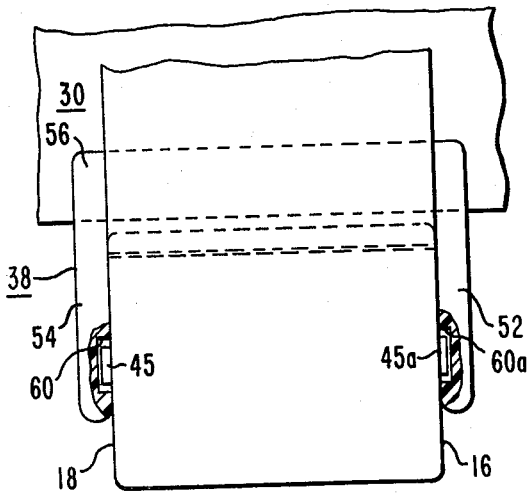
FIG. 3 is a fragmentary side elevational view, with parts broken away, of the current transformer shown in FIG. 1.

In order to removably attach and retain the adaptors 36 and 38, the transformer adaptor arrangement includes two pairs of projections such as indicated by the broken lines designated 41 and 42 and 44 and 45 in FIG. 1 on the transformer end wall 18. Two pairs of upper and lower projections identical to the projections 41 and 42 and 44 and 45 are identically positioned on the transformer end wall 16. Accordingly, each retainer end projection of one end wall is axially aligned with a projection on the other end wall. For example, the upper pair of projections 41*a* and 42*a* on the transformer end wall 16, shown in FIG. 2, are axially aligned with the upper pair of projections 41 and 42 of the on the end 18, respectively. One of the lower pairs of projections 45*a* is shown in FIG. 3 as it is axially aligned with the projection 45. The pairs of projections on both ends are formed as described for the end wall 18 such that the upper pair of projections 41 and 42 and the lower pair of projections 44 and 45 are equally spaced from the center vertical axis 14 and from the inner wall surface of the oval transformer opening 12. The end projections of both end walls 16 and 18 are all substantially the same size and configuration and are molded integrally with the molding step providing the casing of the current transformer 10. The projections have a substantially short cylindrical or button-like configuration.

Figure 4:
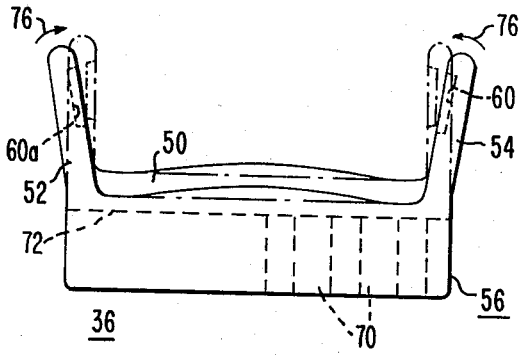
FIG. 4 is a side elevational view of one of the bus bar adaptors shown in FIG. 1.
Figure 6:
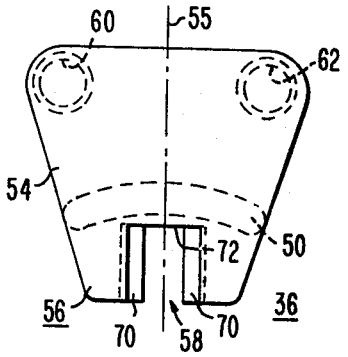
FIG. 6 is an end elevational view of the bus bar adaptor shown in FIG. 1.
Figure 5:
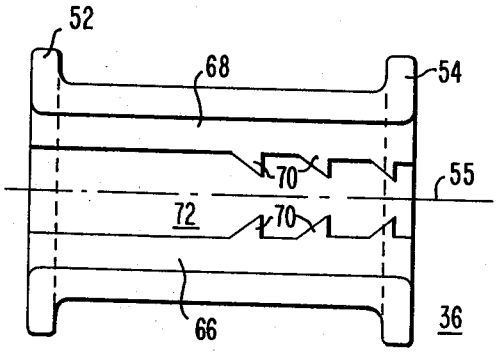
FIG. 5 is an inner and bottom elevational view of the bus bar adaptor shown in FIG. 4.

Having described the adaptor retainer end projections at the transformer end walls 16 and 18, the details of the identical first and second adaptors 36 and 38 are now described taking the adaptor 36 and FIGS. 4, 5 and 6 as identical to the adaptor 38. The side elevational view of the adaptor 36 in FIG. 4 indicates its U-shaped configuration including a base 50 terminated by the sides 52 and 54 of the U-shaped configuration. The sides 52 and 54 define a pair of attachment members extending radially outwardly and are formed symmetrically about a center longitudinal axis 55 thereof which coincides with the axis 14 when the adaptor is attached to the current transformer 10. The attachment sides 52 and 54 are spaced substantially equal to the width of the current transformer or the distance between the end walls 16 and 18 so that they extend over the transformer ends when the base 50 is positioned within the opening 12 and aligned with the axis 14. A bar mounting portion 56 extends inwardly from the bottom of the base 50 to form a slot 58 for receiving the rectangular bar conductor 30 as shown in FIG. 1.

Each of the pair of attachment sides includes a pair of symmetrically arranged circular recesses indicated by the numerals 60 and 62 in the side 52 and 60*a* and 62*a* in the attachment side 54. Each pair of recesses is formed in each attachment side so as to have the centers thereof spaced apart the same distance that the centers of the pair of transformer end projections on the transformer end walls are spaced apart. Each of the adaptor recesses is tapered slightly outward and has the smaller closed end diameter being substantially equal to or slightly larger than the diameter of the transformer end projections so that they are receivable by the recesses as shown in the broken away enlarged view of FIG. 3. Thus, when the pair of attachment sides 52 and 54 are positioned over the transformer end walls so that the pairs of recesses of each are positioned for receiving the corresponding pairs of end projections, the base 50 of each adaptor is aligned and positioned against the surface of the inner wall 13 of the transformer opening 12. The attached adaptor is oriented in its indexed position for being aligned with and receiving the bar conductor 30 for securing the transformer 10 thereto. When both of the first and second adaptors 36 and 38 are attached to the end walls of the transformer, they are in the symmetrically-retained relationship relative to the center vertical axis 14 of the transformer. Also, the adaptors have the adjacently close fitting and mating relationship with the transformer inner wall surface and further have the mounting slots 58 of each in coplanar alignment for mutually securing the transformer.

The outer surface of the base 50 of each adaptor has a convex arcuate contour in a plane perpendicular to the elongated or longitudinal axis 55 of the adaptor as shown in FIG. 6. The convexly arcuate surface of the base 50 is made to substantially conform to and match the oval contour of the surface areas of the inner wall 13 forming the opening 12 on either side of the center axis 14 at the top and bottom thereof.

Referring now in more detail to the mounting portion 56 to the adaptor 36 of the present invention as shown in FIGS. 4, 5 and 6, the mounting slot 58, noted hereinabove, extends parallel to the center longitudinal axis 55 and below the base 50. The side walls 66 and 68 of the mounting portion 56 define the sides of the slot 58. Tapered or sawtooth projections 70 extend toward each other into the slot 58 from the sidewalls 66 and 68 and from the slot bottom 72. As shown in FIG. 5, the teeth 70 extend in mutually opposingly-disposed pairs and have a common direction of taper so as to permit the adaptor to be moved along the rectangular bar conductor 30 when it is received by the slot 58 to position the current transformer 10 thereon. The teeth 70 further provide resilient gripping of the bar conductor 30 to secure the transformer 10 in a predetermined position. To accommodate larger and thicker rectangular bar conductors, the teeth 70 can be removed from one or both of the side walls 66 and 68 and the bottom 72 by being carved or cut away by means of a knife tool.

The bus bar adaptors 36 and 38 are made as a single molded insulating piece preferably of a thermoplastic urethane material such as sold as Texin 480A available from Mobay Chemical Corp., Pittsburgh, Pa. The attachment sides 52 and 54 of each of the adaptors extend so as to be slightly divergent due to a slight convex bow in the base part 50 along the longitudinal axis 55 as shown in the side elevational view of FIG. 4 when the adaptor is in its detached and independent form. The divergence of the attachment sides 52 and 54 facilitates assembly and attachment of the adaptors when fitting them over the transformer end walls and the sets of end projections thereof. When the mounting slot 58 is fitted over the straight rectangular bar conductor 30, the closed end 72 of the slot 58 is made snug against the straight edge of the bar conductor 30 so that the base 50 is straightened to cause the attachment sides 52 and 54 to cam toward each other, as indicated by the arrows 76 in FIG. 4, and against the transformer ends 16 and 18 and thereby more fully receive and surround the retainer projections within the pairs of recesses 60 and 62 and 60*a* and 62*a*. Thus, the pair of adaptors 36 and 38 are securely retained on the transformer end walls 16 and 18 due to the mutually interlocking attachment arrangement provided by the recesses of the attachment sides 52 and 54 and the transformer retainer end projections extending therefrom. The adaptors 36 and 38 are further attached within the opening 12 so that the mounting slots 58 of each of the pair of adaptors are coplanarly aligned in a predetermined index relationship to receive the rectangular bar conductor 30 and thereby positively secure the current transformer 10 thereon.

While a preferred embodiment of the present invention is described hereinabove, it is apparent to those skilled in the art that obvious modifications and alterations may be made without departing from the scope and spirit of our invention.

We claim:

1. A bus bar adaptor arrangement and window type current transformer including a casing having a continuous inner wall defining a center opening for receiving a primary conductor and a pair of end walls extending around the ends of said opening, comprising:

plural retainer projections extending outwardly from both of said end walls of said transformer casing at predetermined symmetrically disposed positions thereof with each being in mutual axial alignment with another retainer projection extending from the other transformer end wall;

a one-piece bus bar adaptor made of a molded insulating material including a U-shaped side configuration having a base conforming to the inner wall surface of said transformer opening, further including a pair of flat attachment members extending outwardly from said base so as to define the sides of said U-shaped configuration positioned over the ends of said current transformer, and still further including a mounting portion having parallel spaced side walls defining a bar receiving slot disposed inwardly from said base, said attachment sides including recessed portions in mutually facing relationship wherein each recess conforms to the shape of said retainer projections and receives said projections in a complementary fashion so as to attach said adaptor within said transformer opening in a predetermined indexed relationship such that said bar receiving slot is disposed parallel to the axis of said opening for receiving a rectangular bar conductor said adaptor being detachably assembled to said retainer projections.

2. The bus bar adaptor arrangement as claimed in claim 1 wherein said retainer projections are disposed in pairs on each side of the center vertical axis of said transformer and wherein each of said attachment sides of said bus bar adaptor include a pair of said recessed portions for receiving each of said pairs of retainer projections.

3. A bus bar adaptor arrangement securing and mounting a window type current transformer wherein said current transformer has a molded insulation casing having an inner wall forming a primary conductor opening and opposite end walls extending around the ends of the inner wall, comprising:

retainer projections extending from both the top and bottom of said opposite end walls of said transformer casing and extending so that each retainer projection of one end is mutually aligned with a retainer projection of the other end;

first and second bus bar adaptors each made of an integrally molded insulation material, and each of said adaptors including a U-shaped side configuration formed by a base part shaped to conform to the contour of said inner wall of said transformer opening and being terminated by flat attachment sides extending outwardly for positioning over the opposite transformer end walls and each adaptor further including a mounting portion having a pair of spaced side walls extending inwardly from said base to define an elongated slot, said flat attachment sides including recesses conforming to the shape of said retainer projections and positioned for mutually receiving said retainer projections extending from the opposite end walls of the transformer when said first and second adaptors are assembled to the opening of said current transformer and aligned with the center vertical axis thereof, said first and second adaptors being detachably assembled to said retainer projections at the top and the bottom of the opposite ends of said transformer casing, respectively, so that said first and second adaptors are symmetrically aligned in a predetermined indexed relationship with the elongated slots thereof being in coalignment along the center vertical axis for receiving the opposite sides of a rectangular bar primary conductor and securing said current transformer thereto in a fixed predetermined relationship.

4. The bus bar adaptor arrangement as claimed in claim 3 wherein pairs of said retainer projections are provided at both the top and bottom of the opposite end walls of said transformer casing and wherein said flat attachment sides each include a pair of recessed portions spaced to receive a corresponding pair of said retainer projections for attaching and maintaining said first and second adaptors at the predetermined indexed positions.

* * * * *